US008276651B2

(12) United States Patent
Min et al.

(10) Patent No.: US 8,276,651 B2
(45) Date of Patent: Oct. 2, 2012

(54) COOLING SYSTEM FOR A VEHICLE

(75) Inventors: Eun Gi Min, Daejeon (KR); Gil Woong Jun, Daejeon (KR); Jun-Il Jang, Daejeon (KR); Byung-Joo Kim, Daejeon (KR); Sun An Jeong, Daejeon (KR); Sang Ok Lee, Daejeon (KR)

(73) Assignee: Halla Climate Control Corp., Daejeon (KR)

( * ) Notice: Subject to any disclaimer, the term of this patent is extended or adjusted under 35 U.S.C. 154(b) by 414 days.

(21) Appl. No.: 12/665,334

(22) PCT Filed: Jun. 16, 2008

(86) PCT No.: PCT/KR2008/003387

§ 371 (c)(1),
(2), (4) Date: Dec. 18, 2009

(87) PCT Pub. No.: WO2008/156271

PCT Pub. Date: Dec. 24, 2008

(65) Prior Publication Data

US 2010/0212874 A1 Aug. 26, 2010

(30) Foreign Application Priority Data

Jun. 20, 2007 (KR) ..... 10-2007-0060807

(51) Int. Cl.
*F28D 7/10* (2006.01)
*F28B 1/00* (2006.01)

(52) U.S. Cl. ..... 165/140; 165/110

(58) Field of Classification Search ..... 165/140, 165/110, 175, 176, 144, 148, 916
See application file for complete search history.

(56) References Cited

U.S. PATENT DOCUMENTS

| | | | | |
|---|---|---|---|---|
| 5,366,005 | A | 11/1994 | Kadle | |
| 5,645,125 | A | 7/1997 | Kroetsch et al. | |
| 6,250,381 | B1 * | 6/2001 | Nishishita | 165/175 |
| 6,394,176 | B1 | 5/2002 | Marsais | |
| 6,904,770 | B2 | 6/2005 | Telesz et al. | |

(Continued)

FOREIGN PATENT DOCUMENTS

| | | |
|---|---|---|
| EP | 0855566 | 7/1998 |

(Continued)

*Primary Examiner* — Tho V Duong
(74) *Attorney, Agent, or Firm* — Lowe Hauptman Ham & Berner LLP

(57) ABSTRACT

The cooling system for a vehicle comprises a heat exchanger in which a condenser 200 comprising a plurality of tubes 112, 220; a pair of tanks 210; and fins 113, 230 and in which a condenser 200 comprised of portions 210B, 220, 230 through which the refrigerant is flowed is integrally formed with a first oil cooler 110 comprised of portions 210A, 112, 113 through which the oil is flowed; a radiator 300 which comprises a plurality of radiator tubes 320; a pair of radiator tanks 310; and radiator fins 330, and which is positioned at a down stream of the condenser 200 in the air blow direction; and a second oil cooler 120 which is provided in one of the radiator tanks 310 of the radiator 300.

6 Claims, 7 Drawing Sheets

U.S. PATENT DOCUMENTS

| | | | | |
|---|---|---|---|---|
| 7,143,822 | B2 * | 12/2006 | Wisniewski | 165/140 |
| 7,516,779 | B1 * | 4/2009 | Marcus | 165/140 |
| 2005/0016716 | A1 * | 1/2005 | Hu et al. | 165/110 |
| 2005/0217839 | A1 * | 10/2005 | Papapanu | 165/185 |
| 2005/0236146 | A1 | 10/2005 | Busse | |
| 2006/0113068 | A1 | 6/2006 | Desai et al. | |
| 2006/0278378 | A1 * | 12/2006 | Okura et al. | 165/140 |
| 2007/0246201 | A1 * | 10/2007 | Hori et al. | 165/140 |

FOREIGN PATENT DOCUMENTS

| | | |
|---|---|---|
| EP | 1003005 | 11/1999 |
| JP | 5-163944 | 6/1993 |
| JP | 10-238347 | 9/1998 |
| JP | 11-192833 | 7/1999 |
| JP | 11-337292 | 10/1999 |
| WO | 2005057116 | 12/2004 |

* cited by examiner

【Figure 1】 Prior Art
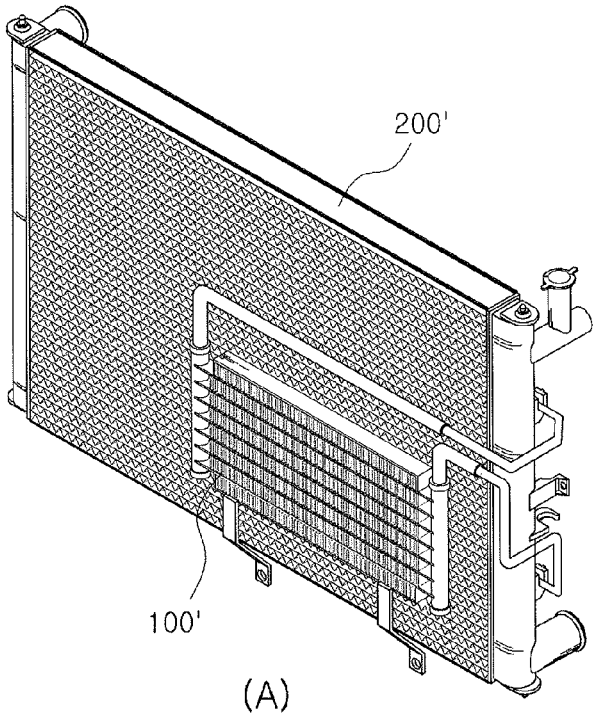
(A)
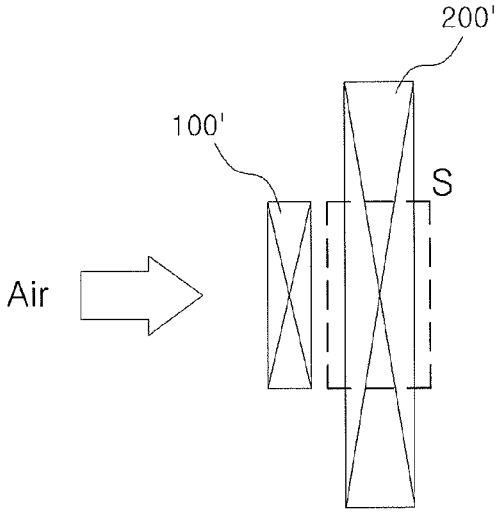
(B)
Prior Art

【Figure 2】 Prior Art
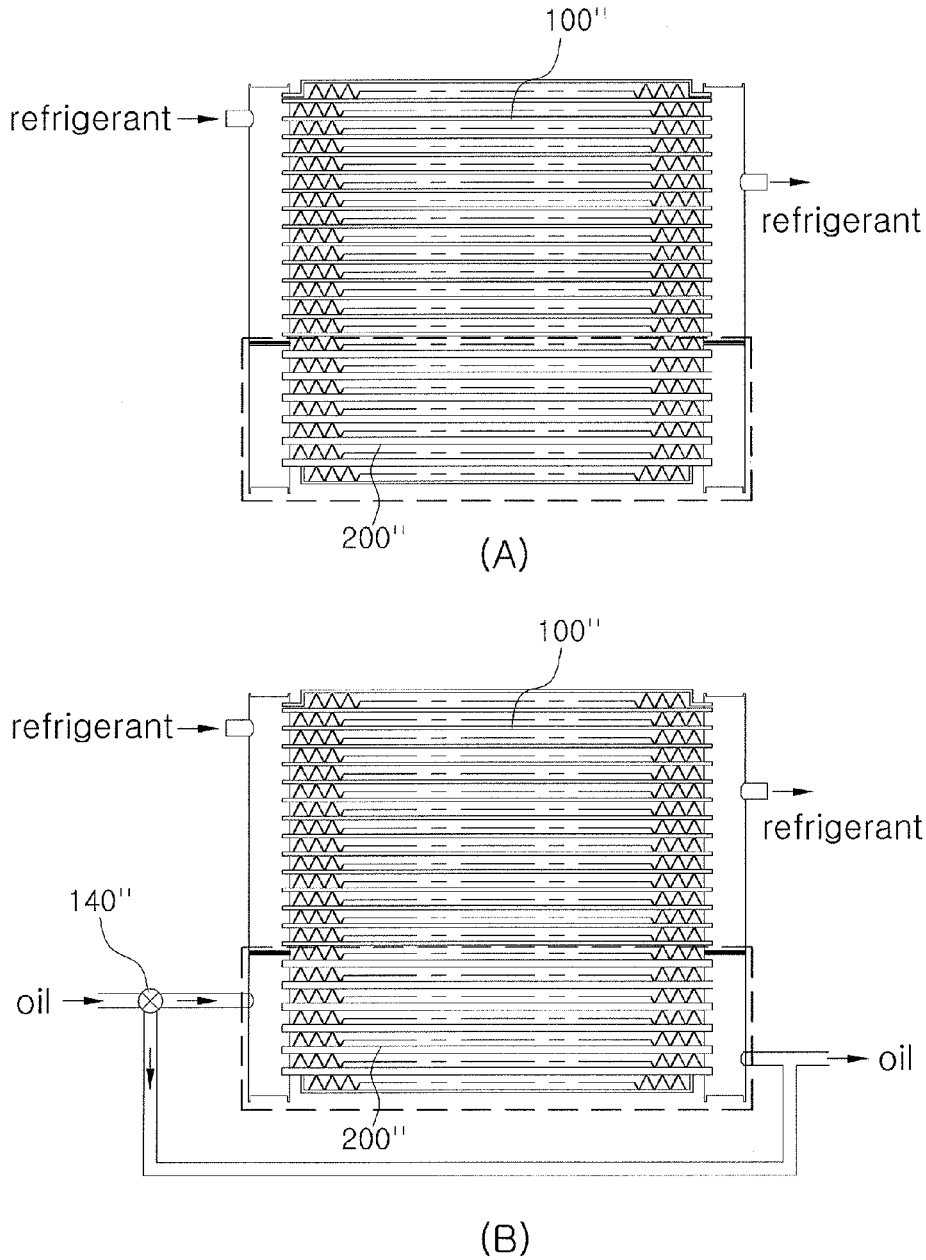
Prior Art

【Figure 3】
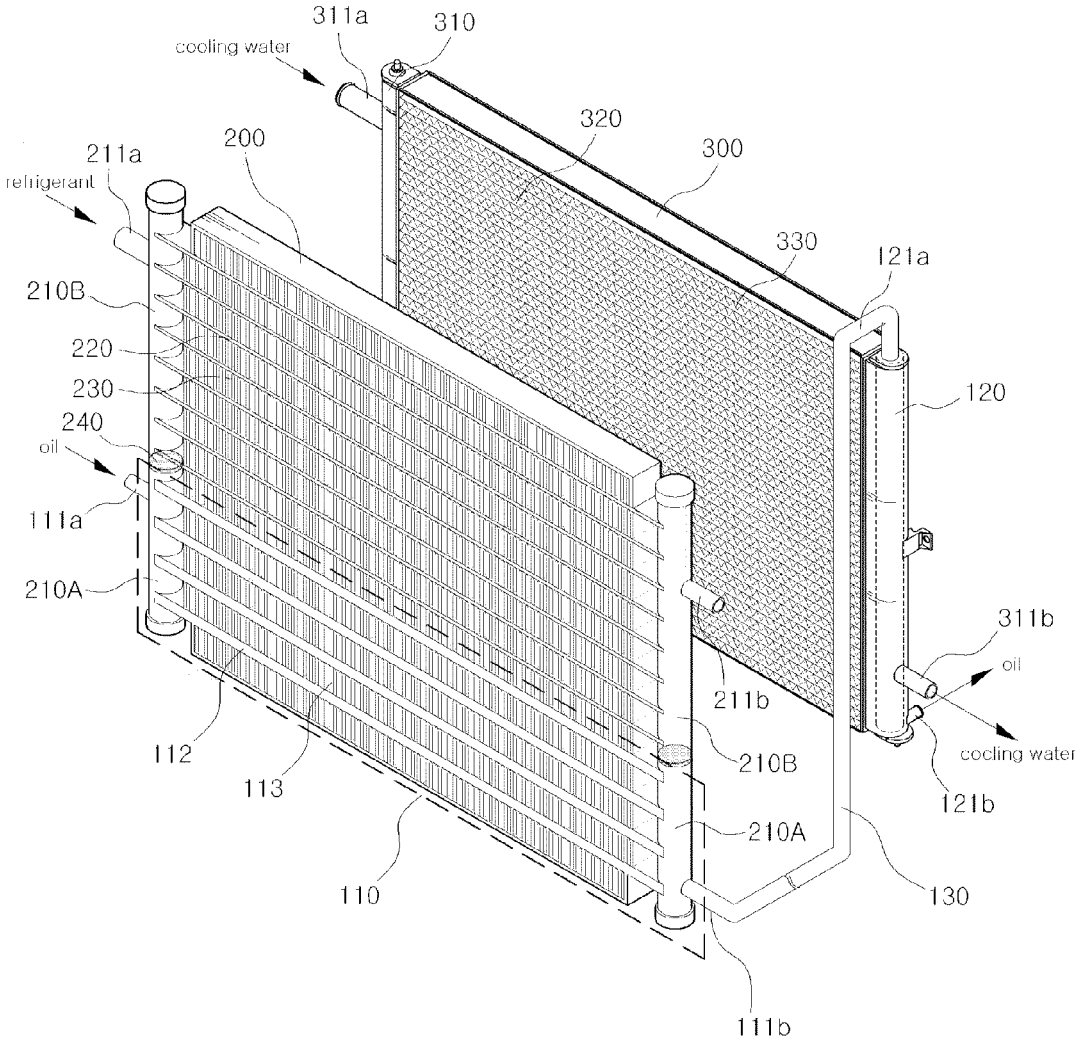

【Figure 4】
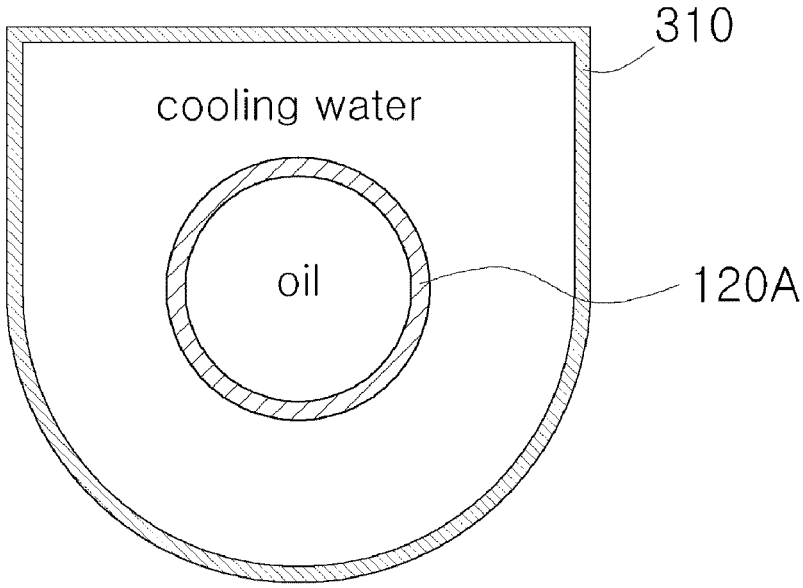
(A)
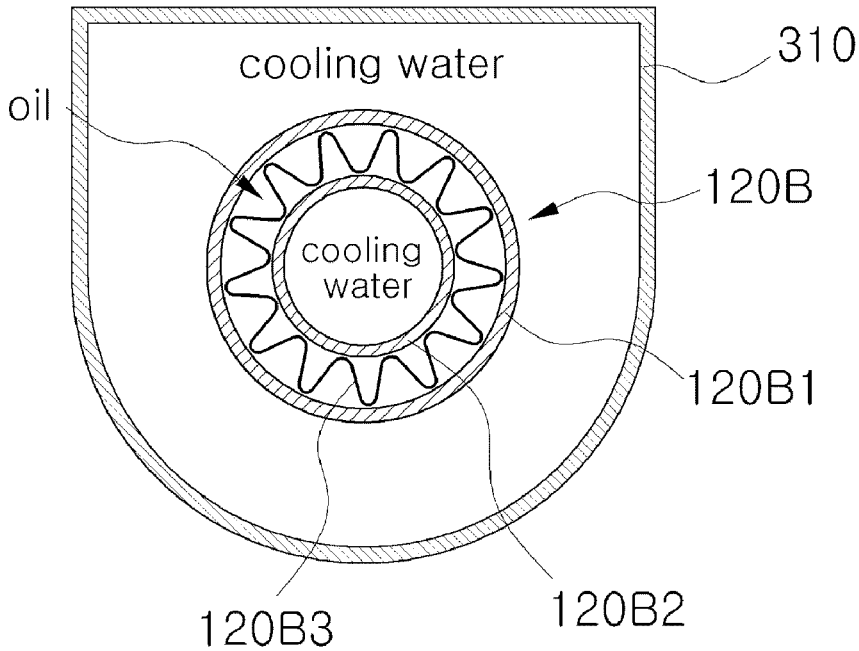
(B)

【Figure 5】
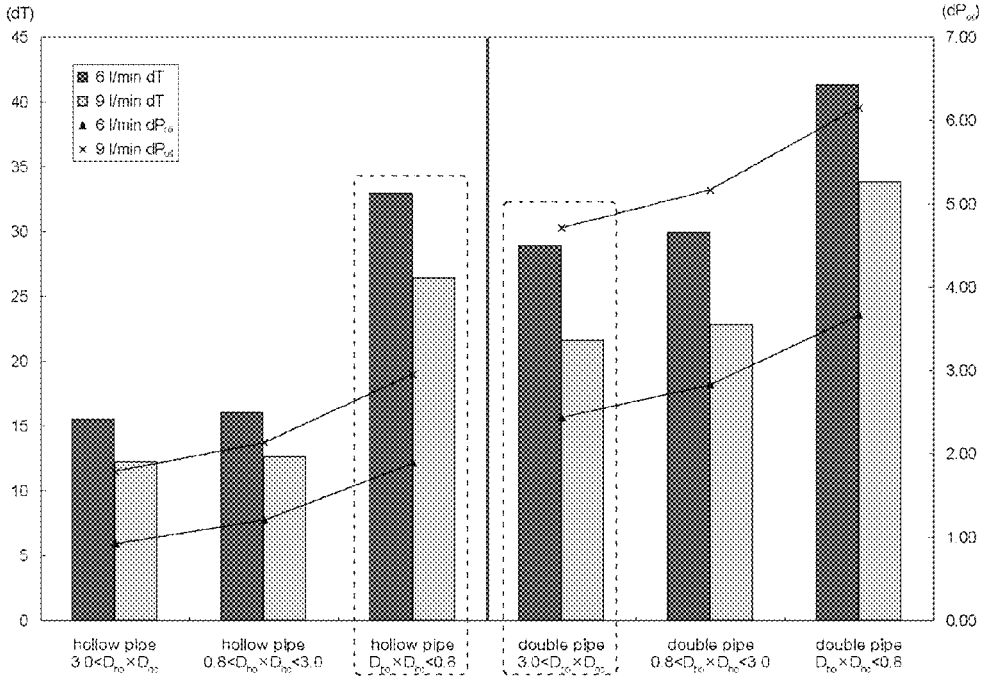

【Figure 6】
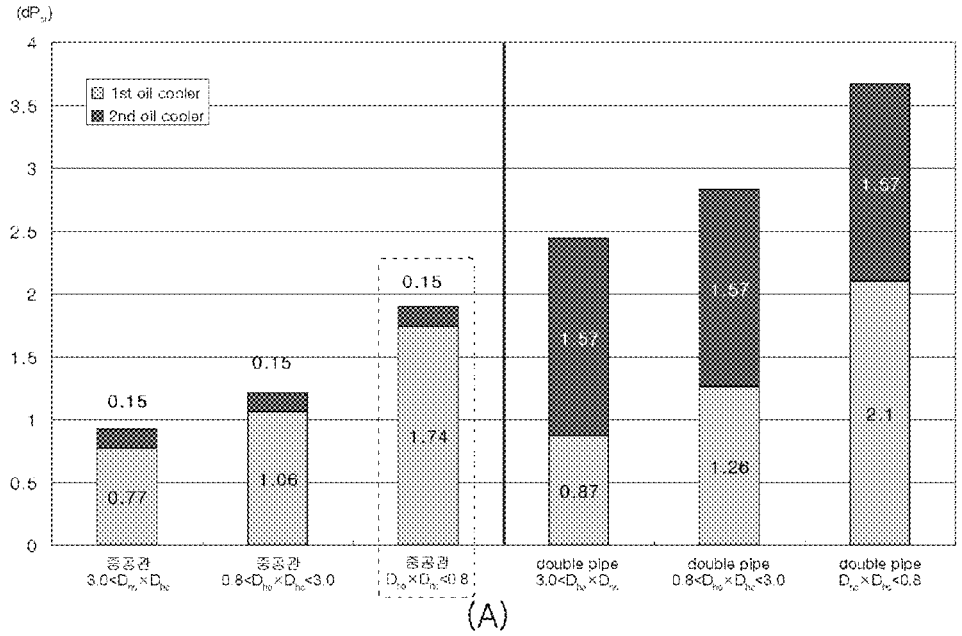
(A)
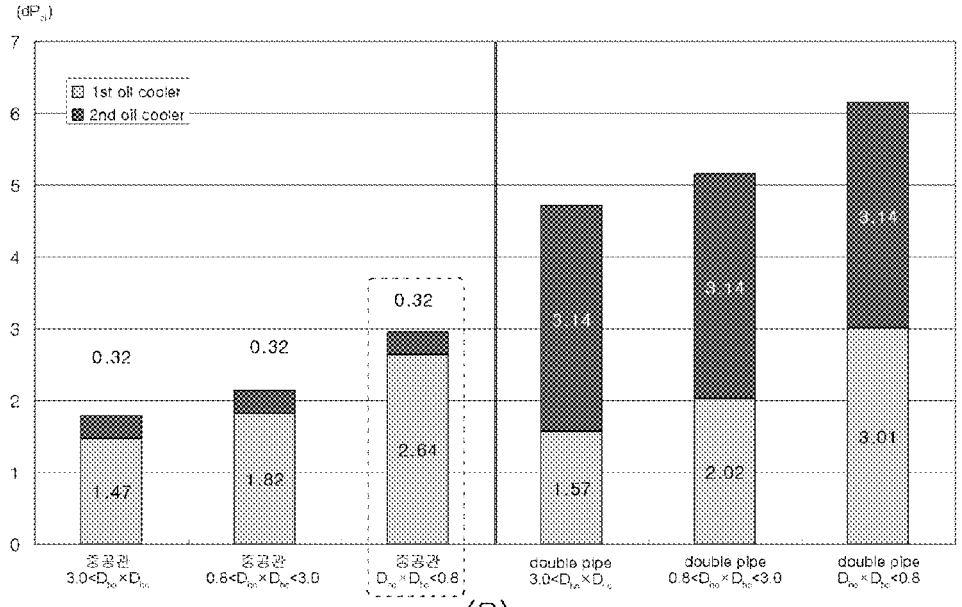
(B)

【Figure 7】
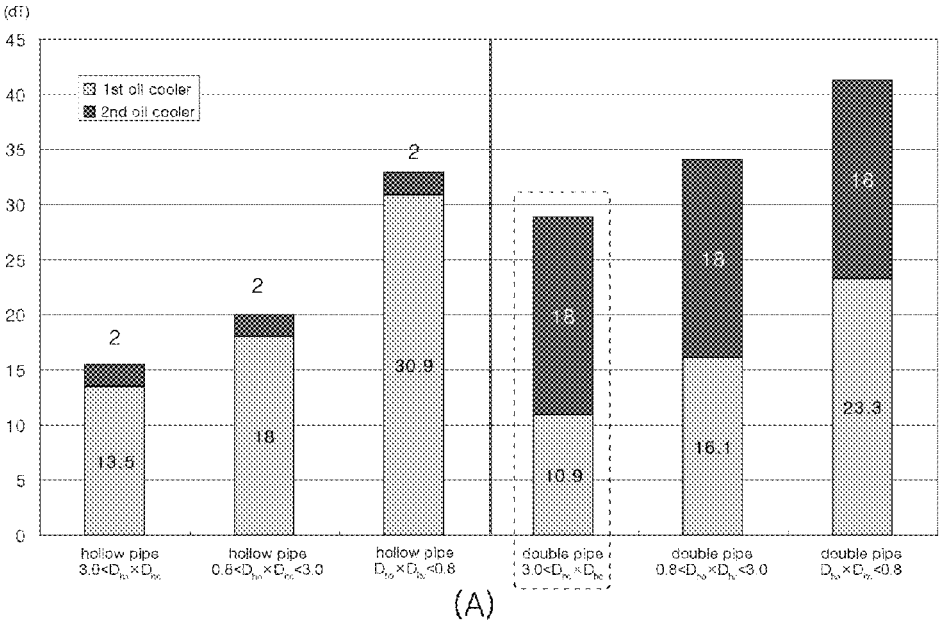
(A)
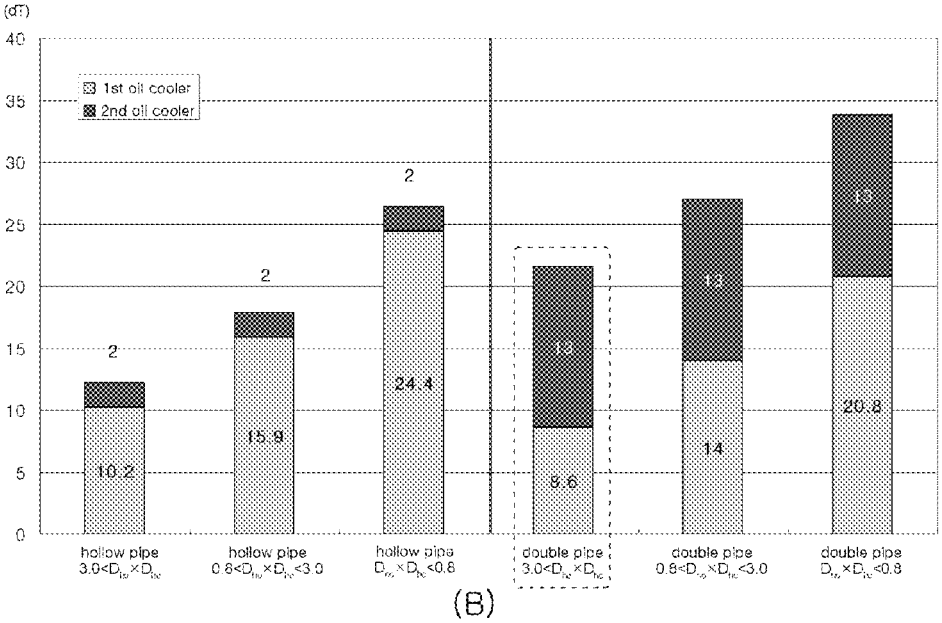
(B)

COOLING SYSTEM FOR A VEHICLE

RELATED APPLICATIONS

The present application is based on, and claims priority from, KR Application Number 10-2007-0060807, filed Jun. 20, 2007, and PCT Application Number PCT/KR08/003387, filed Jun. 16, 2008, the disclosures of which are hereby incorporated by reference herein in their entireties.

TECHNICAL FIELD

The present invention relates to a cooling system for a vehicle, and more particularly, to a cooling system for a vehicle, which has an improved structure for enhancing heat exchanging performance and preventing low temperature impact.

BACKGROUND ART

A heat exchanger serves between two environments, which have a difference in temperature, to absorb heat from one side and then emit the heat to the other side. In a general air conditioning system of a vehicle including evaporator for absorbing heat from the periphery thereof, a compressor for compressing refrigerant, a condenser for emitting the heat to the periphery thereof and an expansion valve for expanding the refrigerant, the evaporator, the condenser and the like are the typical heat exchangers. In the air conditioning system, the gaseous refrigerant introduced from the evaporator to the compressor is compressed at high temperature and high pressure, and while the compressed refrigerant is liquefied by passing through the condenser, heat of liquefaction is emitted to the periphery, and the liquefied refrigerant is converted again into a low temperature and low pressure wet vapor state by passing through the expansion valve and then introduced into the evaporator so as to be vaporized. As described above, the cooling occurs substantially by the evaporator in which the liquid refrigerant is vaporized by absorbing a quantity of heat corresponding to the heat of liquefaction from the periphery, and the inside of a vehicle can be air-conditioned by air cooled around the periphery of evaporator. Further, in order to increase cooling efficiency of the air conditioning system, the condenser is generally provided at a front side of the vehicle.

In addition, the vehicle is provided with other cooling system like an oil cooler as well as the air conditioning system for cooling the inside of the vehicle. A vehicle engine or transmission is filled with oil which serves to remove friction and maintain airtight condition. If the oil is excessively heated, a viscosity of the oil is lowered, and thus it is not possible to perform its functions (i.e., removing of the friction and the maintaining of airtight condition). Particularly, since the function of removing the friction is deteriorated, it is apprehended that parts of the engine and the like may be damaged. Therefore, in order to prevent the above-mentioned phenomena, the oil cooler is used as a means for cooling the oil.

FIG. 1 is a perspective view showing an arrangement configuration of conventional oil cooler and condenser. As shown in FIG. 1A, an oil cooler 100' is disposed at a front side of a condenser 200' so as to partially cover a surface of the condenser 200'. A heat exchange medium (oil in case of the oil cooler and refrigerant in case of the condenser) is flowed in the oil cooler 100' and the condenser 200', like in a typical heat exchanger, and the heat exchange is performed among a tube, a fin and the air therearound. However, in the conventional oil cooler 100' and condenser 200' as shown in FIG. 1B, when the air blows to a portion where the oil cooler 100' and the condenser 200' are overlapped with each other, since the air should pass through the two kinds of heat exchangers, air resistance is remarkably increased and thus heat exchange performance of the condenser 200' is considerably deteriorated. Furthermore, through a portion S of the condenser 200', which is overlapped with the oil cooler 100' and placed at a right rear side of the oil cooler 100', high temperature air heated by the oil cooler 100' passes and thus condensing efficiency of the condenser 200' is rapidly deteriorated.

To prevent the above-mentioned problems, there has been developed a condenser which is integrally formed with an oil cooler. FIG. 2 shows the condenser integrated with the oil cooler. As shown in FIG. 2A, there are provided tubes and which are disposed in a row between a pair of tanks and which fins and are interposed therebetween, and baffles are provided in the tanks so as to divide a space for the flow of the heat exchange medium into two parts one of which is used as the oil cooler tube and the other is used as the condenser tube. That is, in the heat exchanger shown in FIG. 2, oil is flowed into the oil cooler tube forming the oil cooler 100" and refrigerant is flowed into the condenser tube forming the condenser 200", so that the heat exchange occurs in each of the oil cooler 100" and the condenser 200". The FIG. 2 shows that the oil cooler 100" is positioned at a lower side of the condenser 200", however, the positions thereof may be changed. However, even in case of the condenser integrated with the oil cooler, there are some problems. First, since the only way to improve the cooling performance of the oil cooler 100" and the condenser 200" is to change a height or a material of each tube, there is a limit to the improvement of the cooling performance.

In addition, the oil generally has a property that its viscosity is increased at a lower temperature. Therefore, in case of the cold region or the winter season that the temperature is very low, since the oil is further cooled by the oil cooler 100" in spite that its viscosity is higher than need be at the early stage of starting, it is apprehended that parts of the engine may be damaged. This phenomenon is called "low-temperature impact".

In the conventional condenser integrated with the oil cooler, to prevent the low-temperature impact, as shown in FIG. 2B, there is provided a bypass valve 140". By using the bypass valve 140", a path B through which the oil does not pass the oil cooler 100" is selected when the viscosity is higher than a standard state, and a path A through which the oil pass the oil cooler 100" is selected when the viscosity is in a normal state. However, when such the bypass valve 140" is used, it further complicates control of the cooling system. Moreover, since further parts like the bypass valve 140", which are accessorily necessary, are required, a product price is increased, and an internal space in an engine room becomes narrow.

DISCLOSURE

Technical Problem

An object of the present invention is to provide a cooling system for a vehicle which is extended to an oil cooler integrated with a condenser so as to form a water-cooled oil cooler, thereby providing a simple structure, improving heat exchange performance, preventing low-temperature impact and having excellent space utility.

Another object of the present invention is to provide preferable specifications which can additionally provide a water-cooled oil cooler to an existing air-cooled oil cooler integrated with a condenser and also which can improve cooling efficiency by appropriately distributing the air-cooled and water-cooled types.

Technical Solution

To achieve the above objects, the present invention provides a cooling system for a vehicle, comprising a heat exchanger in which a condenser 200 comprising a plurality of tubes 112, 220 which are parallely disposed in an air blow direction so as to be apart from each other at regular intervals; a pair of tanks 210 which are disposed at both sides of the plurality of tubes 112, 220 and respectively divided by a baffle 240 into two independent spaces through which refrigerant and oil are respectively flowed; and fins 113, 230 which are interposed between the tubes 112, 220 so as to increase a heat transfer surface area to air which passes between the tubes 112, 220, and in which a condenser 200 comprised of portions 210B, 220, 230 through which the refrigerant is flowed is integrally formed with a first oil cooler 110 comprised of portions 210A, 112, 113 through which the oil is flowed; a radiator 300 which comprises a plurality of radiator tubes 320 which are parallely disposed in an air blow direction so as to be apart from each other at regular intervals; a pair of radiator tanks 310 which are disposed at both sides of the plurality of radiator tubes 320 and through which cooling water is flowed; and radiator fins 330 which are interposed between the radiator tubes 320 so as to increase the heat transfer surface area to air which passes between the radiator tubes 320, and which is positioned at a down stream of the condenser 200 in the air blow direction; and a second oil cooler 120 which is provided in one of the radiator tanks 310 of the radiator 300, wherein, when a multiplication of a hydraulic diameter $D_{hc}$ of the condenser 200 and a hydraulic diameter $D_{ho}$ of the oil cooler 110 is in an extent of 0.4 $mm^2 \leqq D_{ho} \times D_{hc} \leqq 0.8$ $mm^2$, the second oil cooler 120 is a hollow pipe type oil cooler 120A formed into a single pipe.

Preferably, the multiplication of the hydraulic diameter $D_{hc}$ of the condenser 200 and the hydraulic diameter $D_{ho}$ of the oil cooler 110 is in an extent of 0.5 $mm^2 \leqq D_{ho} \times D_{hc} \leqq 0.8$ $mm^2$.

Preferably, a pressure drop $dP_{oil}$ in the hollow pipe type oil cooler 120A is in an extent of 5~14% of a pressure drop $dP_{oil}$ in the first oil cooler 110.

Further, the present invention provides a cooling system for a vehicle, comprising a heat exchanger in which a condenser 200 comprising a plurality of tubes 112, 220 which are parallely disposed in an air blow direction so as to be apart from each other at regular intervals; a pair of tanks 210 which are disposed at both sides of the plurality of tubes 112, 220 and respectively divided by a baffle 240 into two independent spaces through which refrigerant and oil are respectively flowed; and fins 113, 230 which are interposed between the tubes 112, 220 so as to increase a heat transfer surface area to air which passes between the tubes 112, 220, and in which a condenser 200 comprised of portions 210B, 220, 230 through which the refrigerant is flowed is integrally formed with a first oil cooler 110 comprised of portions 210A, 112, 113 through which the oil is flowed; a radiator 300 which comprises a plurality of radiator tubes 320 which are parallely disposed in an air blow direction so as to be apart from each other at regular intervals; a pair of radiator tanks 310 which are disposed at both sides of the plurality of radiator tubes 320 and through which cooling water is flowed; and radiator fins 330 which are interposed between the radiator tubes 320 so as to increase the heat transfer surface area to air which passes between the radiator tubes 320, and which is positioned at a down stream of the condenser 200 in the air blow direction; and a second oil cooler 120 which is provided in one of the radiator tanks 310 of the radiator 300, wherein, when a multiplication of a hydraulic diameter $D_{ho}$ of the condenser 200 and a hydraulic diameter $D_{ho}$ of the oil cooler 110 is in an extent of 3.0 $mm^2 \leqq D_{ho} \times D_{hc} \leqq 4.5$ $mm^2$, the second oil cooler 120 is a double pipe type oil cooler 120B which is comprised of external and internal pipe 120B1 and 120B2 to be disposed coaxially and an internal fin 120B3 interposed between the external pipe 120B1 and the internal pipe 120B2.

Preferably, the multiplication of the hydraulic diameter $D_{hc}$ of the condenser 200 and the hydraulic diameter $D_{ho}$ of the oil cooler 110 is in an extent of 3.2 $mm^2 \leqq D_{ho} \times D_{hc} \leqq 4.2$ $mm^2$.

Preferably, a temperature difference dT in the double pipe type oil cooler 120B is in an extent of 140~170% of a temperature difference dT in the first oil cooler 110.

Advantageous Effects

According to the present invention, since the oil is cooled by the two oil cooler, i.e., the first oil cooler which is integrally formed with the condenser and the second oil cooler which is formed at the radiator, the heat exchange performance can be remarkably increased, comparing with the conventional oil cooler. Further, in the second oil cooler in which the oil is cooled by the cooling water of the radiator, since the cooling water has a higher temperature than the oil at the early stage of starting that an external temperature is low, the heat is transferred to the oil having a high viscosity due to the low external temperature, and thus the viscosity of the oil can be lowered. Therefore, it is possible to prevent the low-temperature impact without other parts like the bypass valve. Furthermore, since the oil can be cooled by using the simple structure which has not the bypass valve, it is possible to facilely control the cooling system. In addition, since the parts for the bypass valve are omitted, the cost of product can be reduced, and also due to the omission of the bypass valve, the space utility in the engine room can be maximized.

DESCRIPTION OF DRAWINGS

The above and other objects, features and advantages of the present invention will become apparent from the following description of preferred embodiments given in conjunction with the accompanying drawings, in which:

FIG. 1 is a perspective view of conventional oil cooler and condenser.

FIG. 2 is a front view of a conventional condenser integrated with oil cooler.

FIG. 3 is a perspective view of a cooling system for a vehicle according to the present invention.

FIG. 4 is a cross-sectional view of a second oil cooler according to the present invention.

FIG. 5 is a performance graph of the cooling system for the vehicle according to the present invention.

FIG. 6 a graph showing pressure drops of first and second oil coolers according to the present invention.

FIG. 7 is a graph showing temperature differences of the first and second oil coolers according to the present invention.

DETAILED DESCRIPTION OF MAIN ELEMENTS

100', 100": first oil cooler

111*a:* first oil cooler inlet port

111*b:* first oil cooler outlet port
112: first oil cooler tube
113: first oil cooler fin
120: second oil cooler
121*a:* second oil cooler inlet port
121*b:* second oil cooler outlet port
120A: hollow pipe type oil cooler
120B: double pipe type oil cooler
120B1: external pipe
120B2: internal pipe
120B3: internal fin
200: condenser
210: tank
220: condenser tube
230: condenser fin
240: baffle
300: radiator
310: radiator tank
320: radiator tube
330: radiator fin

BEST MODE

Hereinafter, the embodiments of the present invention will be described in detail with reference to accompanying drawings.

FIG. 3 is a perspective view of a cooling system for a vehicle according to the present invention. As shown in FIG. 3, a cooling system for a vehicle of the present invention includes a first oil cooler 110 which is integrally formed with a condenser 200, and a second oil cooler 120 which is disposed in a tank 310 of a radiator 300.

The first oil cooler 110 is formed as a part of a heat exchanger including a plurality of tubes 112, 220 which are parallely disposed in an air blow direction so as to be apart from each other at regular intervals; a pair of tanks 210 which are disposed at both sides of the plurality of tubes 112, 220 and respectively divided by a baffle 240 into two independent spaces through which refrigerant and oil are respectively flowed; and fins 113, 230 which are interposed between the tubes 112, 220 so as to increase a heat transfer surface area to air which passes between the tubes 112, 220. In other words, as shown in FIG. 3, the heat exchanger includes the condenser 200 which is comprised of portions 210B, 220, 230 through which the refrigerant is flowed, and the first oil cooler 110 which is comprised of portions 210A, 112, 113 through which the oil is flowed. The first oil cooler 110 is integrally formed with the condenser 200, which is similar to the conventional condenser integrated with the oil cooler. The FIG. 3 shows that the first oil cooler 110 is positioned at a lower side of the condenser 200, however, the positions thereof may be changed, and for example, the first oil cooler 110 may be positioned at an upper side of the condenser 200.

As shown in FIG. 3, the condenser 200 is generally disposed at a front side of the radiator 300 (i.e., at an upper stream of the air blow direction). The radiator 300 also functions as a heat exchanger, and includes a plurality of radiator tubes 320 which are parallely disposed in an air blow direction so as to be apart from each other at regular intervals; a pair of radiator tanks 310 which are disposed at both sides of the plurality of radiator tubes 320 and through which cooling water is flowed; and radiator fins 330 which are interposed between the radiator tubes 320 so as to increase the heat transfer surface area to air which passes between the radiator tubes 320. The cooling water for cooling an engine is flowed through the radiator 300 and cooled by the air which passes through the radiator 300.

The second oil cooler 120 is disposed in the radiator tank 310, and also formed into a closed tube shape so that the oil flowing in the second oil cooler 120 is not mixed with the cooling water flowing in the radiator tank 310. The second oil cooler 120 functions to perform second heat exchange of the oil from the first oil cooler 110. Therefore, although the heat exchange in the first oil cooler 110 is performed insufficiently, the temperature and viscosity of the oil can be properly maintained by the second heat exchange in the second oil cooler 120.

In a normal operation, since a temperature of the cooling water in the radiator tank 310 is lower than that of the oil in the second oil cooler 120, when the oil is not cooled sufficiently in the first oil cooler 110, the oil emits the heat to the cooling water in the second oil cooler 120, and thus the oil can be cooled additionally, thereby increasing the heat exchange performance of the whole oil cooler 100.

Further, at the early stage of starting that the engine is not heated sufficiently in the conditions that the low-temperature impact occurs, i.e., in the cold region or the winter season that the temperature is very low, since the temperature of the cooling water in the radiator tank 310 is higher than that of the oil in the second oil cooler 120, the oil having an excessively low temperature (i.e., excessively high viscosity) due to the cooling in the first oil cooler 110 absorbs the heat from the cooling water while passing through the second oil cooler 120, and thus the oil is allowed to have a proper temperature and viscosity, thereby preventing the low-temperature impact.

FIG. 4 is a cross-sectional view of the second oil cooler according to the present invention, FIG. 4A shows a hollow pipe type oil cooler, and FIG. 4B shows a double pipe type oil cooler. The second oil cooler 120 is formed into a tube and disposed in the radiator tank 310. The second oil cooler 120 may have the hollow pipe shape as shown in FIG. 4A or the double pipe shape as shown in FIG. 4B.

The hollow pipe type oil cooler 120A of FIG. 4A, which has a single tube shape, is disposed in the radiator tank 310, and at a wall surface of the hollow pipe type oil cooler 120A, the heat exchange is performed between the oil and the cooling water.

The double pipe type oil cooler 120B of FIG. 4B, which is comprised of an external pipe 120B1 and an internal pipe 120B2 to be disposed coaxially, is disposed in the radiator tank 310, and an internal fin 120B3 is interposed between the external pipe 120B1 and the internal pipe 120B2. The oil is flowed between the external pipe 120B1 and the internal pipe 120B2, and the cooling water is flowed outside the external pipe 120Ba and inside the internal pipe 120B2. Therefore, since the double pipe type oil cooler 120B of FIG. 4B has a larger heat transfer surface area comparing with the hollow pipe type oil cooler 120A of FIG. 4A, the heat exchange performance is improved. In addition, due to the internal fin 120B3 interposed between the external pipe 120B1 and the internal pipe 120B2, the heat exchange performance can be further improved. However, since the double pipe type oil cooler 120B has a complicated structure comparing with the hollow pipe type oil cooler 120A, the double pipe type oil cooler 120B has large flow resistance, and thus the pressure drop is increased.

FIG. 5 is a performance graph of the second oil cooler 120, which shows a temperature difference dT due to heat emission and a pressure drop $dP_{oil}$ in various conditions of the hollow pipe type oil cooler 120A and the double pipe type oil cooler 120B. In FIG. 5, the left side shows a graph for the hollow pipe type oil cooler 120A and the right side shows a graph for the double pipe type oil cooler 120B. Further, line graphs indicated by triangular points are a pressure drop $dP_{oil}$ when a flow rate of the oil is 61/min, and line graphs indicated by x points are a pressure drop $dP_{oil}$ when a flow rate of the oil is 91/min. Bar graphs indicated by light colors are temperature differences dT when a flow rate of the oil is 61/min, and bar graphs indicated by strong colors are temperature differences dT when a flow rate of the oil is 91/min (herein, the temperature difference dT is proportional to the heat emission). $D_{ho}$ and $D_{hc}$ in an x-axis are a hydraulic diameter of the oil cooler and a hydraulic diameter of the condenser, respectively.

As shown in drawings, it can be understood that the double pipe type oil cooler 120B has an excellent heat emission performance and a lower pressure drop, comparing with the hollow pipe type oil cooler 120A.

Meanwhile, to improve the heat exchange performance, the conventional oil cooler integrated with the condenser, as shown in FIG. 2, was designed in such a manner of determining optimum values by adjusting the hydraulic diameter $D_{ho}$ of the oil cooler and the hydraulic diameter $D_{hc}$ of the condenser. In the design manner, a value of $D_{ho}\times D_{hc}$ is frequently used as a parameter for the optimum design. FIG. 5 is a graph showing data obtained by experiments using the condenser 200 having a hydraulic diameter $D_{hc}$ of 0.75 to 0.85 and the first oil cooler 110 having various hydraulic diameters $D_{ho}$. As described in the drawing, in both of the hollow pipe type oil cooler 120A and the double pipe type oil cooler 120B, the temperature difference dT and the pressure drop $dP_{oil}$ are increased according as the value of $D_{ho}\times D_{hc}$ is decreased.

In case that the value of $D_{ho}\times D_{hc}$ is smaller than 0.8, it means that a hydraulic diameter of the oil cooler tube in the first oil cooler 110 is very small, I.e., the oil cooler tube has a very narrow cross section. In this case, the heat transfer surface area is substantially increased, and thus the heat exchange is smoothly performed between the oil in the oil cooler tube and the external air. Therefore, the heat emission in the first oil cooler 110 is increased, but the pressure drop in the first oil cooler 110 is increased due to increase in the flow resistance.

On the contrary, in case that the value of $D_{ho}\times D_{hc}$ is larger than 3, it means that the hydraulic diameter of the oil cooler tube in the first oil cooler 110 is very large, I.e., the oil cooler tube has a very wide cross section. In this case, since the heat transfer surface area is substantially reduced, the heat emission in the first oil cooler 110 is decreased, but the pressure drop in the first oil cooler 110 is decreased due to decrease in the flow resistance.

In this point of view, it is preferable that the second cooler 120 is designed so as to have a performance contrary to that in the first oil cooler 110. That is, in case that the value of $D_{ho}\times D_{hc}$ is smaller than 0.8 (i.e., increase of the heat emission and pressure drop in the first oil cooler 110), it is preferable that the second oil cooler 120 is designed to have a structure that the pressure drop is small, although the heat emission in the second oil cooler 120 is decreased. On the contrary, in case that the value of $D_{ho}\times D_{hc}$ is larger than 3 (i.e., decrease of the heat emission and pressure drop in the first oil cooler 110), it is preferable that the second oil cooler 120 is designed to have a structure that the heat emission is large, although the pressure drop in the second oil cooler 120 is increased.

On the basis of such the points in design, in case that the value of $D_{ho}\times D_{hc}$ is smaller than 0.8, since the heat emission occurs sufficiently in the first oil cooler 110 but the pressure drop is increased, the present invention employs the hollow pipe type oil cooler 120A as the second oil cooler 120 in which the pressure drop is small due to the small flow resistance although the heat emission is somewhat small. On the contrary, in case that the value of $D_{ho}\times D_{hc}$ is larger than 3, since the pressure drop is decreased in the first oil cooler 110 but the heat emission occurs insufficiently, the present invention employs the double pipe type oil cooler 120B as the second oil cooler 120 in which the heat emission is large due to the internal fins and the like although the pressure drop is somewhat large. According to the present invention as described above, since the first and second oil coolers 110 and 120 are mutually complemented in their performance, it is further facile to design the cooling system so that the heat exchange performance is increased.

It is preferable to use the hollow pipe type oil cooler 120A, when the value of $D_{ho}\times D_{hc}$ is smaller than 0.8, preferably $0.4\ mm^2 \leqq D_{ho}\times D_{hc} \leqq 0.8\ mm^2$ more preferably $0.5\ mm^2 \leqq D_{ho}\times D_{hc} \leqq 0.8\ mm^2$. And it is preferable to use the double pipe type oil cooler 120B, when the value of $D_{ho}\times D_{hc}$ is, preferably $3.0\ mm^2 \leqq D_{ho}\times D_{hc} \leqq 4.5\ mm^2$, more preferably $3.2\ mm^2 \leqq D_{ho}\times D_{hc} \leqq 4.2\ mm^2$.

FIG. 6 a graph showing pressure drops of first and second oil coolers according to the present invention, wherein FIG. 6A is a pressure drop $dP_{oil}$ when a flow rate of the oil is 61/min, and FIG. 6B is a pressure drop $dP_{oil}$ when a flow rate of the oil is 91/min. Further, the left side of the drawing is in case that the second oil cooler 120 is the hollow pipe type oil cooler 120A, and the right side of the drawing is in case that the second oil cooler 120 is the double pipe type oil cooler 120B. And in each graph, a light colored portion shows a pressure drop in the first oil cooler 110, and a strong colored portion shows a pressure drop in the second oil cooler 120.

When the hollow pipe type oil cooler 120A is used as the second oil cooler 120, the pressure drop in the hollow pipe type oil cooler 120A with respect to the pressure drop in the first oil cooler 110 is about 19% (a flow rate of the oil is 61/min)/about 22% (91/min) in a range that the value of $D_{ho}\times D_{hc}$ is larger than 3, is about 14% (61/min)/about 18% (91/min) in a range that the value of $D_{ho}\times D_{hc}$ is between 0.8 and 3, and is about 9% (61/min)/about 12% (91/min) in a range that the value of $D_{ho}\times D_{hc}$ is smaller than 0.8.

According to the experiment results, as the value of $D_{ho}\times D_{hc}$ is lowered, the heat transfer surface area of the first oil cooler 110 is increased, but the pressure drop is increased. Herein, it is preferable most of the oil is cooled at a place that the pressure drop is small, so as to prevent overworking of the parts. Therefore, in designing of the hollow pipe type oil cooler 120A, it is preferable that the pressure drop in the first oil cooler 110 is in an extent of 5~14%.

FIG. 7 is a graph showing temperature differences of the first and second oil coolers according to the present invention, wherein FIG. 7A is a temperature difference dT when a flow rate of the oil is 61/min, and FIG. 7B is a temperature difference dT when a flow rate of the oil is 91/min. Further, the left side of the drawing is in case that the second oil cooler 120 is the hollow pipe type oil cooler 120A, and the right side of the drawing is in case that the second oil cooler 120 is the double pipe type oil cooler 120B. And in each graph, a light colored portion shows a temperature difference dT in the first oil cooler 110, and a strong colored portion shows a temperature difference dT in the second oil cooler 120.

In case that the double pipe type oil cooler 120B is used as the second oil cooler 120, the temperature difference in the double pipe type oil cooler 120B with respect to the temperature difference in the first oil cooler 110 is about 165% (a flow rate of the oil is 6l/min)/about 150% (91/min) in a range that the value of $D_{ho}\times D_{hc}$ is larger than 3, is about 112% (61/min)/about 93% (91/min) in a range that the value of $D_{ho}\times D_{hc}$ is between 0.8 and 3, and is about 77% (61/min)/about 63% (91/min) in a range that the value of $D_{ho}\times D_{hc}$ is smaller than 0.8.

According to the experiment results, as the value of $D_{ho}\times D_{hc}$ is increased, the pressure drop of the first oil cooler 110 is increased, but the temperature difference, i.e., heat emission is also increased. Herein, in an aspect of the whole heat emission performance, it can be understood that the heat emission performance in the first oil cooler 110 is considerably deteriorated. Therefore, in designing of the double pipe type oil cooler 120B, it is preferable that the temperature difference in the double pipe type oil cooler 120B with respect to the temperature difference in the first oil cooler 110 is in an extent of 140~170%.

Those skilled in the art will appreciate that the conceptions and specific embodiments disclosed in the foregoing description may be readily utilized as a basis for modifying or designing other embodiments for carrying out the same purposes of the present invention. Those skilled in the art will also appreciate that such equivalent embodiments do not depart from the spirit and scope of the invention as set forth in the appended claims.

[Industrial Applicability]

According to the present invention, as described above, since the oil is cooled by the two oil cooler, i.e., the first oil cooler which is integrally formed with the condenser and the second oil cooler which is formed at the radiator, the heat exchange performance can be remarkably increased, comparing with the conventional oil cooler. Further, in the second oil cooler in which the oil is cooled by the cooling water of the radiator, since the cooling water has a higher temperature than the oil at the early stage of starting that an external temperature is low, the heat is transferred to the oil having a high viscosity due to the low external temperature, and thus the viscosity of the oil can be lowered. Therefore, it is possible to prevent the low-temperature impact without other parts like the bypass valve. Furthermore, since the oil can be cooled by using the simple structure which has not the bypass valve, it is possible to facilely control the cooling system. In addition, since the parts for the bypass valve are omitted, the cost of product can be reduced, and also due to the omission of the bypass valve, the space utility in the engine room can be maximized.

The invention claimed is:

1. A cooling system for a vehicle, comprising:

a heat exchanger in which a condenser (200) comprising a plurality of tubes (112, 220) which are parallely disposed in an air blow direction so as to be apart from each other at regular intervals; a pair of tanks (210) which are disposed at both sides of the plurality of tubes (112, 220) and respectively divided by a baffle (240) into two independent spaces through which refrigerant and oil are respectively flowed; and fins (113, 230) which are interposed between the tubes (112, 220) so as to increase a heat transfer surface area to air which passes between the tubes (112, 220), and in which a condenser (200) comprised of portions (210B, 220, 230) through which the refrigerant is flowed is integrally formed with a first oil cooler (110) comprised of portions (210A, 112, 113) through which the oil is flowed;

a radiator (300) which comprises a plurality of radiator tubes (320) which are parallely disposed in an air blow direction so as to be apart from each other at regular intervals; a pair of radiator tanks (310) which are disposed at both sides of the plurality of radiator tubes (320) and through which cooling water is flowed; and radiator fins (330) which are interposed between the radiator tubes (320) so as to increase the heat transfer surface area to air which passes between the radiator tubes (320), and which is positioned at a down stream of the condenser (200) in the air blow direction; and a second oil cooler (120) which is provided in one of the radiator tanks (310) of the radiator (300), wherein, when a multiplication of a hydraulic diameter ($D_{hc}$) of the condenser (200) and a hydraulic diameter ($D_{ho}$) of the oil cooler (110) is in an extent of 0.4 $mm^2 \leqq (D_{ho} \times D_{hc}) \leqq 0.8\ mm^2$, the second oil cooler (120) is a hollow pipe type oil cooler (120A) formed into a single pipe.

2. The cooling system according to claim 1, wherein the multiplication of the hydraulic diameter ($D_{hc}$) of the condenser (200) and the hydraulic diameter ($D_{ho}$) of the oil cooler (110) is in an extent of 0.5 $mm^2 \leqq (D_{ho} \times D_{hc}) \leqq 0.8\ mm^2$.

3. The cooling system according to claim 1, wherein a pressure drop $dP_{oil}$ in the hollow pipe type oil cooler (120A) is in an extent of 5~14% of a pressure drop $dP_{oil}$ in the first oil cooler (110).

4. A cooling system for a vehicle, comprising:

a heat exchanger in which a condenser (200) comprising a plurality of tubes (112, 220) which are parallely disposed in an air blow direction so as to be apart from each other at regular intervals; a pair of tanks (210) which are disposed at both sides of the plurality of tubes (112, 220) and respectively divided by a baffle (240) into two independent spaces through which refrigerant and oil are respectively flowed; and fins (113, 230) which are interposed between the tubes (112, 220) so as to increase a heat transfer surface area to air which passes between the tubes (112, 220), and in which a condenser (200) comprised of portions (210B, 220, 230) through which the refrigerant is flowed is integrally formed with a first oil cooler (110) comprised of portions (210A, 112, 113) through which the oil is flowed;

a radiator (300) which comprises a plurality of radiator tubes (320) which are parallely disposed in an air blow direction so as to be apart from each other at regular intervals; a pair of radiator tanks (310) which are disposed at both sides of the plurality of radiator tubes (320) and through which cooling water is flowed; and radiator fins (330) which are interposed between the radiator tubes (320) so as to increase the heat transfer surface area to air which passes between the radiator tubes (320), and which is positioned at a down stream of the condenser (200) in the air blow direction; and a second oil cooler (120) which is provided in one of the radiator tanks (310) of the radiator (300), wherein, when a multiplication of a hydraulic diameter ($D_{hc}$) of the condenser (200) and a hydraulic diameter ($D_{ho}$) of the oil cooler (110) is in an extent of 3.0 $mm^2 \leqq (D_{ho} \times D_{hc}) \leqq 4.5\ mm^2$, the second oil cooler (120) is a double pipe type oil cooler (120B) which is comprised of external pipe (120B1) and an internal pipe (120B2) to be disposed coaxially and an internal fin (120B3) interposed between the external pipe (120B1) and the internal pipe (120B2).

5. The cooling system according to claim 1, wherein the multiplication of the hydraulic diameter ($D_{hc}$) of the condenser (200) and the hydraulic diameter ($D_{ho}$) of the oil cooler (110) is in an extent of 3.2 $mm^2 \leqq (D_{ho} \times D_{hc}) \leqq 4.2\ mm^2$.

6. The cooling system according to claim 1, wherein a temperature difference dT in the double pipe type oil cooler (120B) is in an extent of 140~170% of a temperature difference dT in the first oil cooler (110).

* * * * *